US010084245B2

(12) United States Patent
Chang

(10) Patent No.: US 10,084,245 B2
(45) Date of Patent: Sep. 25, 2018

(54) ELECTRICAL CONNECTOR ASSEMBLY

(71) Applicant: LOTES CO., LTD, Keelung (TW)

(72) Inventor: Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/866,783

(22) Filed: Jan. 10, 2018

(65) Prior Publication Data

US 2018/0212337 A1 Jul. 26, 2018

(30) Foreign Application Priority Data

Jan. 24, 2017 (CN) ..... 2017 2 0092116 U

(51) Int. Cl.

| | |
|---|---|
| ***H01R 24/00*** | (2011.01) |
| ***H01R 13/58*** | (2006.01) |
| ***H01R 4/02*** | (2006.01) |
| ***H01R 24/62*** | (2011.01) |
| ***H01R 13/504*** | (2006.01) |
| ***H01R 13/6581*** | (2011.01) |
| ***H01R 13/6594*** | (2011.01) |
| ***H01R 12/58*** | (2011.01) |
| ***H01R 13/66*** | (2006.01) |

(Continued)

(52) U.S. Cl.

CPC ..... *H01R 4/023* (2013.01); *H01R 4/027* (2013.01); *H01R 12/58* (2013.01); *H01R 13/504* (2013.01); *H01R 13/6581* (2013.01); *H01R 13/6594* (2013.01); *H01R 13/6658* (2013.01); *H01R 24/62* (2013.01); *H01R 12/716* (2013.01); *H01R 13/64* (2013.01)

(58) Field of Classification Search

CPC ..... H01R 13/6581; H01R 13/6658; H01R 24/62; H01R 24/60; H01R 4/023; H01R 12/58

See application file for complete search history.

(56) References Cited

U.S. PATENT DOCUMENTS

| | | | | |
|---|---|---|---|---|
| 9,490,549 | B2 * | 11/2016 | Little | H01R 4/023 |
| 9,502,841 | B2 * | 11/2016 | Little | H01R 4/023 |
| 9,577,385 | B1 * | 2/2017 | Lin | H01R 13/6585 |

(Continued)

FOREIGN PATENT DOCUMENTS

| | | |
|---|---|---|
| CN | 204011984 U | 12/2014 |
| CN | 205565175 U | 9/2016 |
| CN | 105990761 A | 10/2016 |

*Primary Examiner* — Xuong Chung Trans

(74) *Attorney, Agent, or Firm* — Locke Lord LLP; Tim Tingkang Xia, Esq.

(57) ABSTRACT

An electrical connector includes an insulating body, a middle shielding sheet, an upper power terminal, a lower power terminal, and a cable. The middle shielding sheet is arranged in the insulating body, and has a base and an extending portion extending backward from the base. The extending portion is recessed with at least one yield slot. The upper power terminal extends to form an upper soldering portion entering a part above the yield slot. The lower power terminal extends to form a lower soldering portion entering a part below the yield slot. The cable has at least one power wire. The power wire has a wire core. The wire core enters the yield slot, extends to a part between the upper soldering portion and the lower soldering portion, and is soldered with the upper soldering portion and the lower soldering portion.

19 Claims, 6 Drawing Sheets

(51) Int. Cl.
*H01R 12/71* (2011.01)
*H01R 13/64* (2006.01)

(56) References Cited

U.S. PATENT DOCUMENTS 9,577,387 B2 * 2/2017 Hu ..... H01R 13/6597
9,601,876 B2 * 3/2017 Jiang ..... H01R 13/6585
9,620,904 B2 * 4/2017 Kao ..... H01R 13/6581
9,680,260 B2 * 6/2017 Fan ..... H01R 13/6585
9,768,568 B1 * 9/2017 Jin ..... H01R 24/60
9,972,945 B1 * 5/2018 Huang ..... H01R 13/6585

* cited by examiner

ELECTRICAL CONNECTOR ASSEMBLY

CROSS-REFERENCE TO RELATED APPLICATION

This non-provisional application claims priority to and benefit of, under 35 U.S.C. § 119(a), Patent Application No. 201720092116.1 filed in P.R. China on Jan. 24, 2017, the entire content of which is hereby incorporated by reference.

FIELD OF THE INVENTION

The present invention relates to an electrical connector assembly, and more particularly to an electrical connector assembly in which terminals are directly soldered to a cable.

BACKGROUND OF THE INVENTION

Nowadays, electrical connectors are widely used in a variety of electronic equipment, and the signal transmission rate is faster and faster with the development of electrical connectors. The existing electrical connector assembly generally includes an insulating body, upper and lower rows of terminals fixedly arranged in the insulating body, a middle shielding sheet fixedly arranged between the two rows of terminals, an outer shell wrapping the insulating body, and a cable soldered with the terminals. Generally, each row of terminals includes at least one ground terminal, at least one power terminal and multiple signal terminals.

Each ground terminal and each power terminal will be soldered separately with a wire, thus the wires are densely arranged, and occupy a very large space, which is not conducive to the miniaturization design of the electrical connector. Further, the signal interference will be caused when each wire transmits signals, and thus the shielding of signal interference is relatively difficult due to the dense arrangement of the wires.

Therefore, a heretofore unaddressed need exists in the art to address the aforementioned deficiencies and inadequacies.

SUMMARY OF THE INVENTION

In one aspect, the present invention relates to an electrical connector assembly that can save space and ensure the shielding effect of the upper row of terminals and the lower row of terminals.

In certain embodiments, an electrical connector assembly includes an insulating body, a middle shielding sheet, an upper row terminal group and a lower row terminal group, and a cable. The middle shielding sheet is disposed in the insulating body. The middle shielding sheet has a base. The base extends backward to form an extending portion. The extending portion is recessed with at least one yield slot. The upper row terminal group and the lower row terminal group are fixedly on the insulating body and respectively positioned at the upper and lower sides of the middle shielding sheet. The upper row terminal group includes at least one upper power terminal and multiple upper signal terminals. The upper power terminal extends to form an upper soldering portion entering a part above the yield slot. The upper signal terminals are positioned over the extending portion. The lower row terminal group includes at least one lower power terminal and multiple lower signal terminals. The lower power terminal extends to form a lower soldering portion entering a part below the yield slot. The lower signal terminals are positioned under the extending portion. The cable includes at least one power wire. The power wire has a wire core. The wire core enters the yield slot, extends to a part between the upper soldering portion and the lower soldering portion, and is soldered with the upper soldering portion and the lower soldering portion.

In certain embodiments, the width of the yield slot is greater than that of the upper soldering portion and the lower soldering portion.

In certain embodiments, the cable has multiple signal wires, and the power wire and the signal wires are arranged up and down in a staggered way in the horizontal direction.

In certain embodiments, the upper row terminal group includes at least one upper ground terminal, the lower row terminal group includes at least one lower ground terminal, the upper ground terminal and the lower ground terminal are positioned on the same vertical direction, the cable has a ground wire, and the ground wire extends to a part between the upper ground terminal and the lower ground terminal, and is electrically connected with the upper ground terminal and the lower ground terminal.

In certain embodiments, the ground wire is electrically connected with the middle shielding sheet.

In certain embodiments, the center of the power wire and the center of the ground wire are positioned on the same horizontal plane.

In certain embodiments, the insulating body is provided with a through slot corresponding to the yield slot, and a gap exists between the through slot and the wire core.

In certain embodiments, the width of the through slot is smaller than that of the yield slot, and the through slot covers the yield slot.

In certain embodiments, the upper row terminal group includes multiple upper signal terminals, each upper signal terminal has an upper soldering pin, the center of the upper soldering portion is lower than that of the upper soldering pin in the vertical direction, the lower row terminal group includes multiple lower signal terminals, each lower signal terminal has a lower soldering pin, and the center of the lower soldering portion is higher than that of the lower soldering pin in the vertical direction.

In certain embodiments, the upper soldering portion and the lower soldering portion extend backward but not beyond the insulating body.

In certain embodiments, both the upper row terminal group and the lower row terminal group have 12 terminals, and the upper row terminal group and the lower row terminal group are arranged in a point symmetry way by taking the central point of the insulating body as a center of symmetry, and both the upper row terminal group and the lower row terminal group meet the universal serial bus (USB) TYPE C terminal arrangement.

In certain embodiments, the insulating body has a main body, the main body is formed by combining an upper insulating block with a lower insulating block, an upper protruding rib is arranged at the rear end of the lower surface of the upper insulating block, a lower protruding rib is arranged at the rear end of the upper surface of the lower insulating block, and the upper protruding rib and the lower protruding rib cover the rear end of the extending portion.

In certain embodiments, the base is provided with a perforation, and the perforation, the wire core and the yield slot are positioned on the same straight line.

In certain embodiments, the upper insulating block and the lower insulating block are provided with a fixing post corresponding to the perforation.

In certain embodiments, the extending portion has a middle plate and at least one side plate, the side plate is positioned at one side of the middle plate, the middle plate is buried in the insulating body, and the side plate is partially buried in the insulating body, and is partially exposed to the insulating body to form a soldering end.

In certain embodiments, the tail end of the middle plate is not flush with the tail end of the side plate.

In certain embodiments, the middle of the base extends forward to form a protruding portion, and the two sides of the base extend forward to form a pair of extending arms.

In certain embodiments, the horizontal widths of the middle plate and the side plate are equal.

Compared with the related art, the yield slot is arranged in the middle shielding sheet, and the wire core extends to a part between an upper contact portion and a lower contact portion, and is soldered with the upper contact portion and the lower contact portion, thereby saving space without affecting the shielding effect of the middle shielding sheet on the upper row terminal group and the lower row terminal group.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
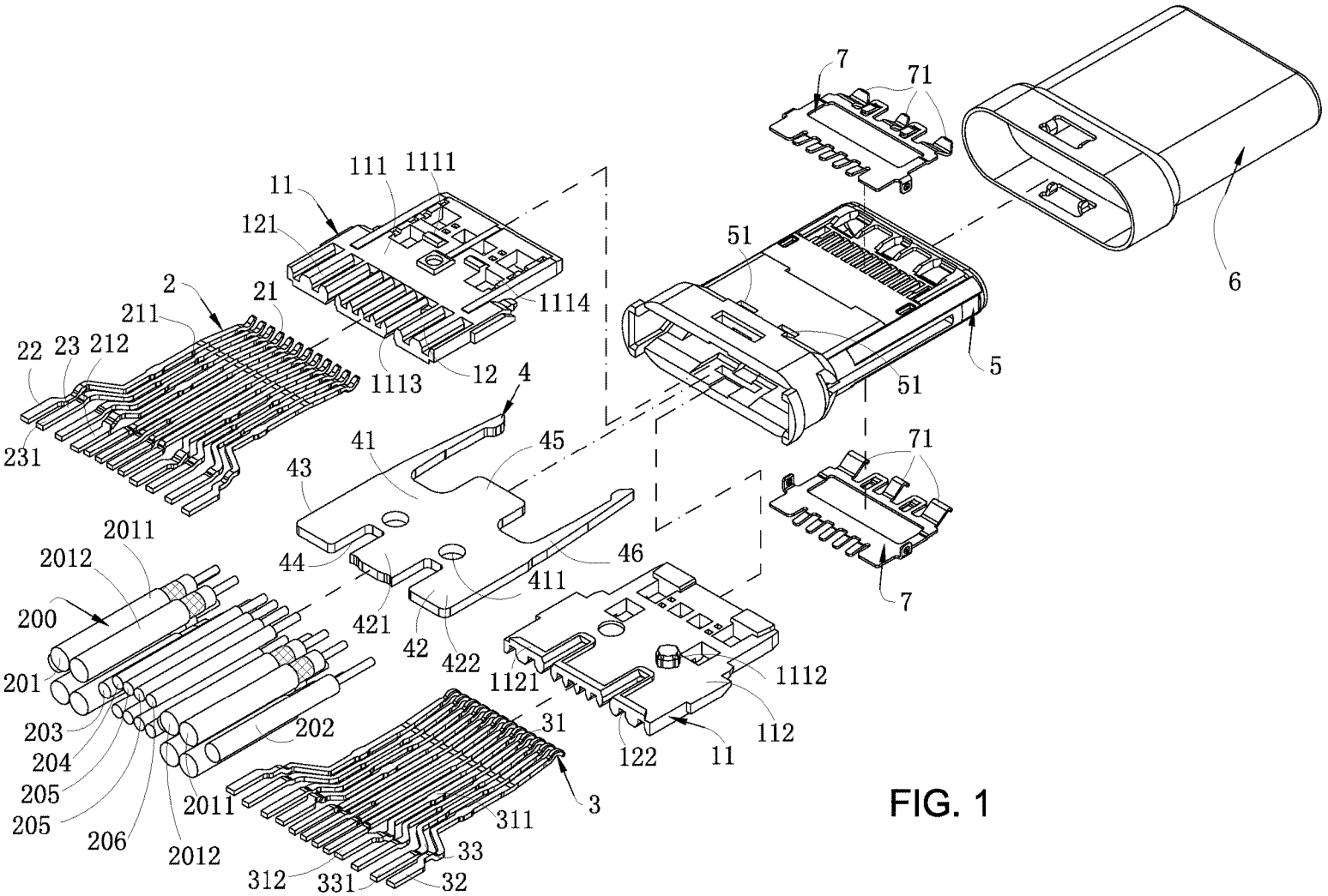
FIG. 1 is a schematic three-dimensional exploded view of an electrical connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector assembly.

Figure 2:
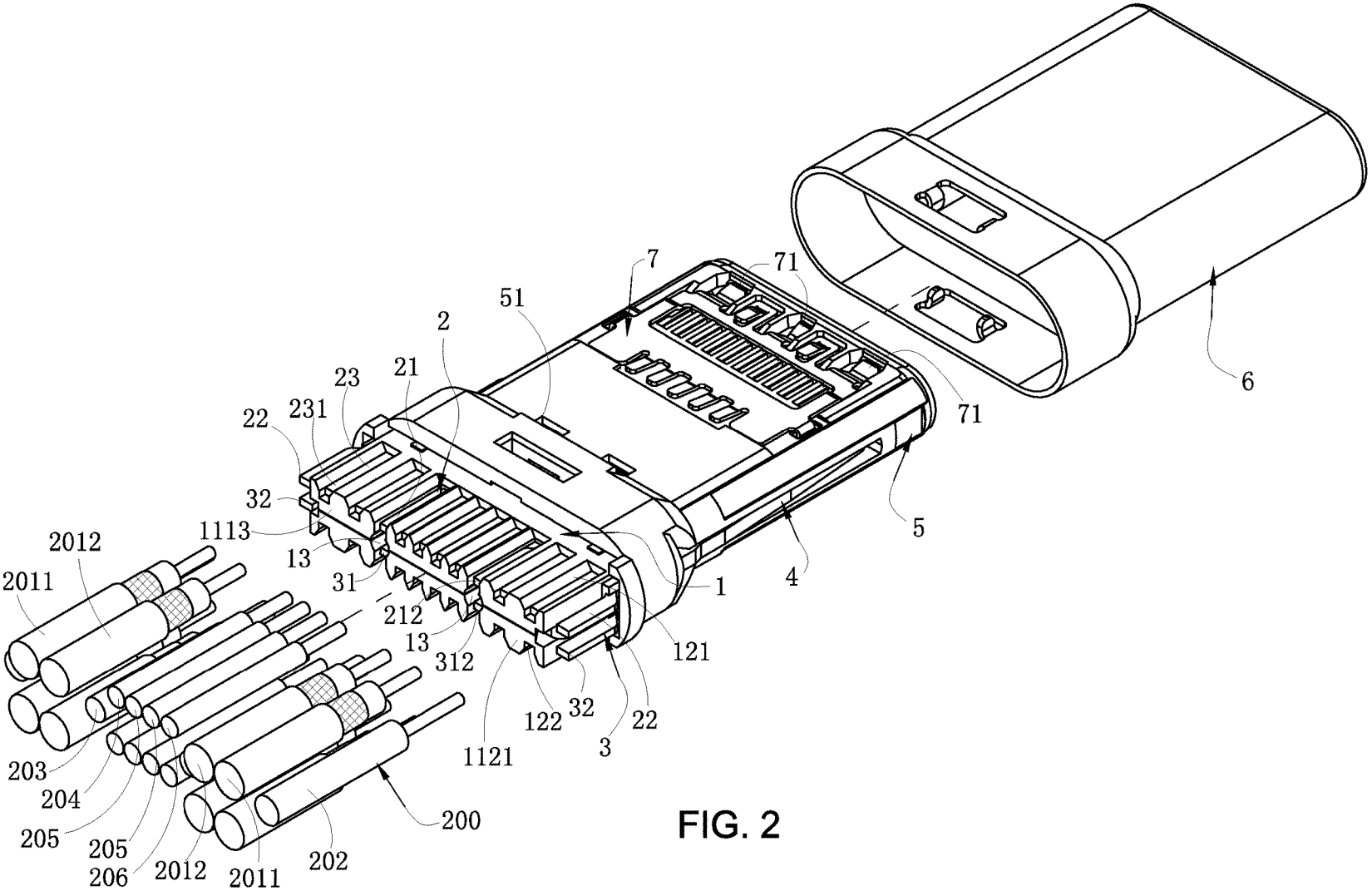
FIG. 2 is a schematic view of soldering of an electrical connector and a cable according to one embodiment of the present invention.
Figure 3:
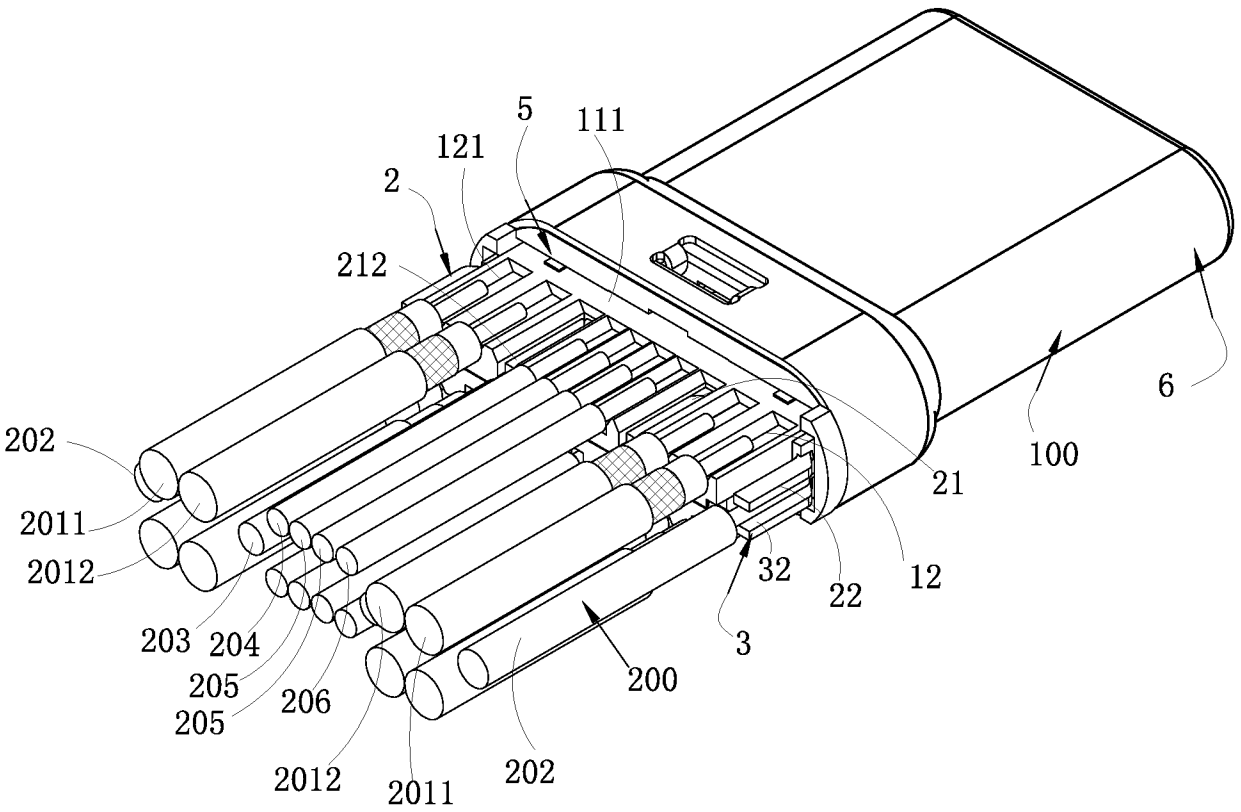
FIG. 3 is a schematic three dimensional assembly view of an electrical connector assembly according to one embodiment of the present invention.

As shown in FIGS. 1-3, an electrical connector assembly according to one embodiment of the present invention includes an electrical connector 100 and a cable 200 electrically connected with the electrical connector 100. The electrical connector 100 includes an insulating body 1, an upper row terminal group 2 and a lower row terminal group 3, a middle shielding sheet 4, an insulating shell 5, and a metal shell 6. The upper row terminal group 2 and the lower row terminal group 3 are fixed to the insulating body 1. The middle shielding sheet 4 is fixed to the insulating body 1 and positioned between the upper row terminal group 2 and the lower row terminal group 3. The cable 200 is soldered with the corresponding upper row terminal group 2 and lower row terminal group 3. The insulating shell 5 is fixed outside the insulating body 1. The metal shell 6 wraps the periphery of the insulating shell 5.

Figure 4:
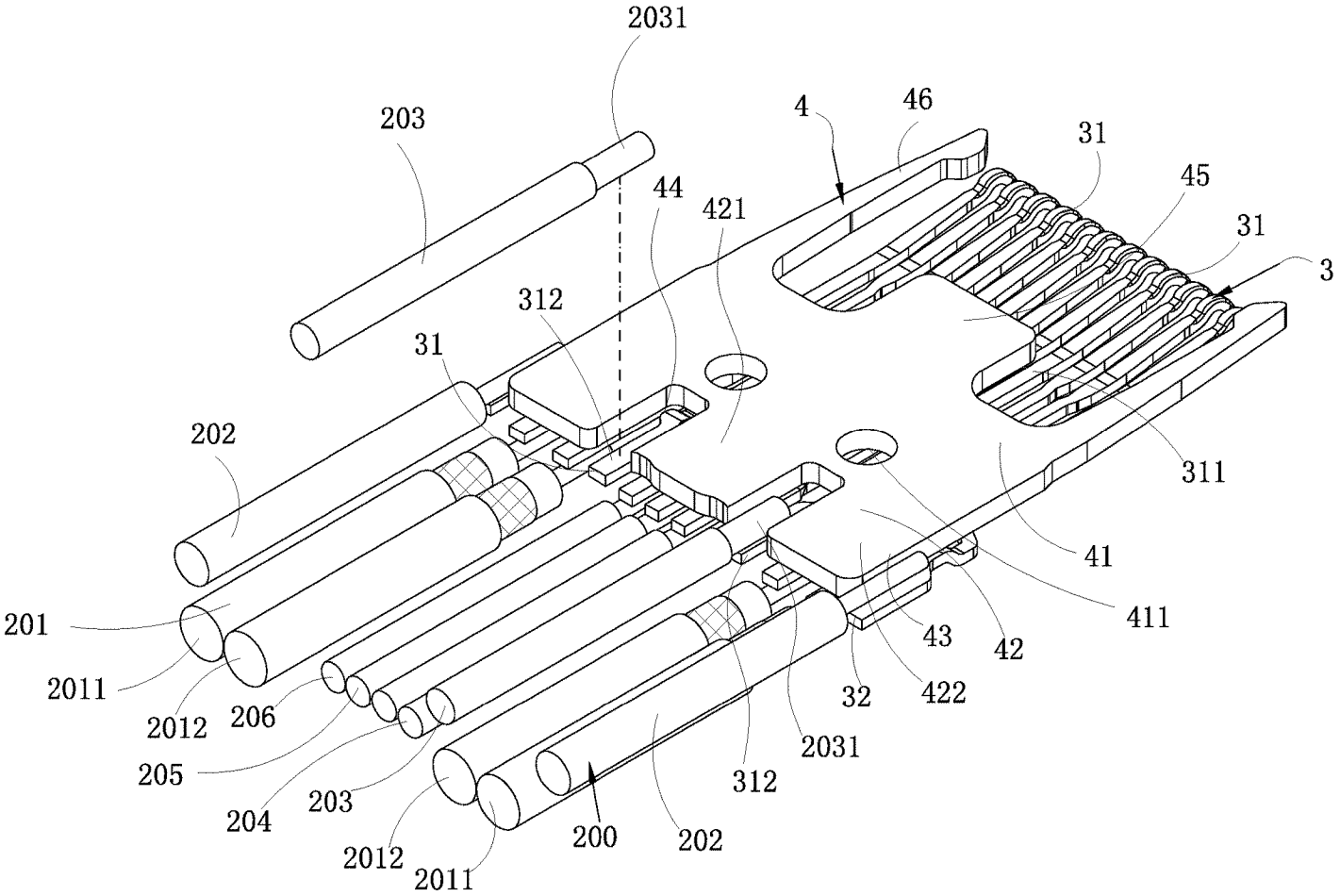
FIG. 4 is a partial exploded view of an electrical connector assembly according to one embodiment of the present invention.

As shown in FIGS. 1, 2 and 4, the insulating body 1 has a main body 11. The main body 11 includes an upper insulating block 111 and a lower insulating block 112. A fixing post 1112 is arranged on the lower insulating block 112 and is accommodated and fixed in a fixed hole 1114 in the upper insulating block 111. Two protruding blocks 1111 are arranged on the upper surface of the upper insulating block 111, and two protruding blocks 1111 are also arranged on the lower surface of the lower insulating block 112. The insulating shell 5 is provided with four through holes 51 corresponding to the four protruding blocks 1111, and the protruding blocks 1111 penetrate through the through holes 51 to fix the main body 11 and the insulating shell 5. An upper protruding rib 1113 is arranged at the rear end of the lower surface of the upper insulating block 111, and a lower protruding rib 1121 corresponding to the upper protruding rib 1113 is arranged at the rear end of the upper surface of the lower insulating block 112. The main body 11 extends backward to form a soldering zone 12. Multiple upper terminal slots 121 are arranged on the upper surface of the soldering zone 12, and multiple lower terminal slots 122 are arranged on the lower surface of the soldering zone 12. The insulating shell 5 is fixedly arranged outside the main body 11. A pair of outer iron sheets 7 is respectively arranged on the upper and lower surfaces of the insulating shell 5, and positioned at the front sides of the upper row terminal group 2 and the lower row terminal group 3. Each outer iron sheet is provided with multiple elastic pieces 71 extending into the insulating shell 5.

Figure 6:
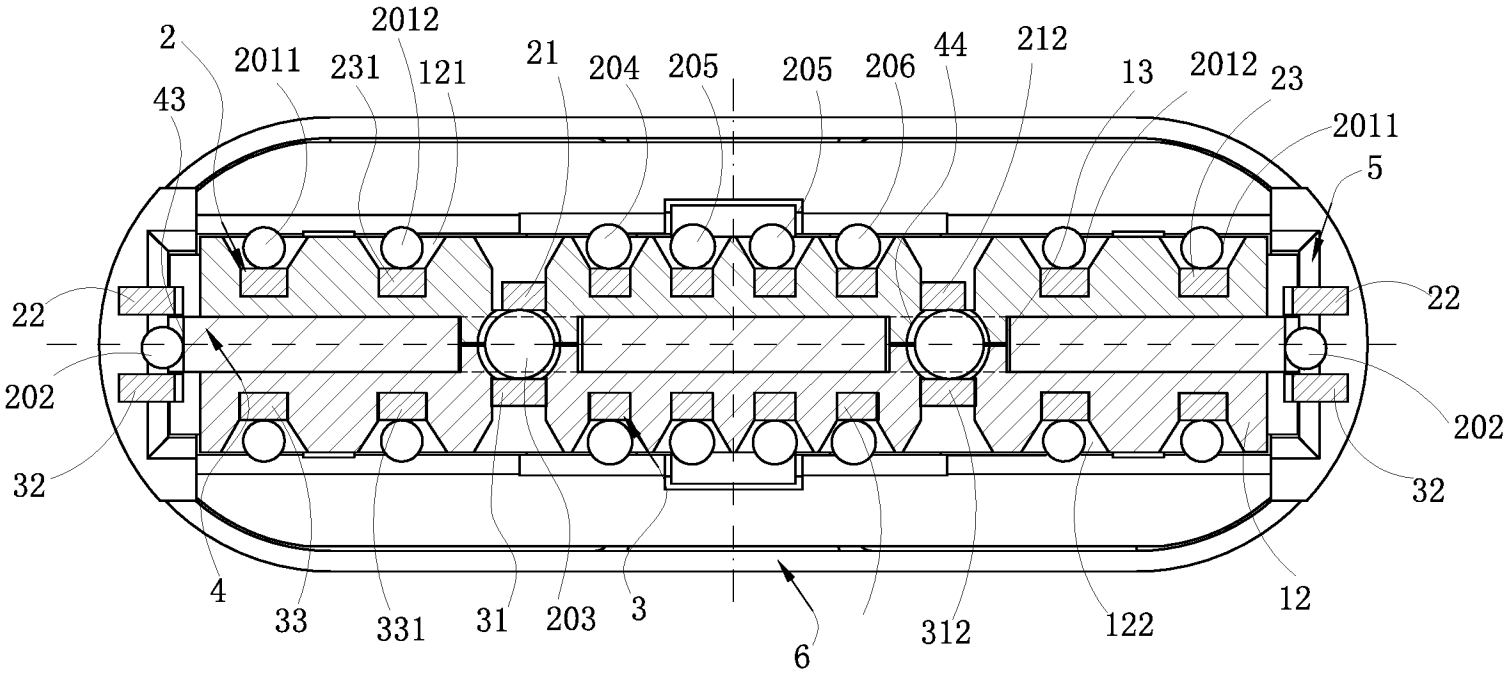
FIG. 6 is a sectional view of an electrical connector assembly according to one embodiment of the present invention.

As shown in FIGS. 1, 4 and 6, the upper row terminal group 2 is fixedly arranged on the upper insulating block 111 through injection molding, and the lower row terminal group 3 is also fixedly arranged on the lower insulating block 112 through injection molding. The upper row terminal group 2 includes two upper power terminals 21, two upper ground terminals 22 and multiple upper signal terminals 23, and the lower row terminal group 3 includes two lower power terminals 31, two lower ground terminals 32 and multiple lower signal terminals 33. The upper power terminal 21 is provided with an upper base portion 211, and the upper base portion 211 extends backward and bends downward to from an upper soldering portion 212, and the lower power terminal 31 is provided with a lower base portion 311, and the lower base portion 311 extends backward and bends downward to from a lower soldering portion 312. The upper soldering portion 212 is arranged not beyond the tail end of the soldering zone 12, and the lower soldering portion 312 is arranged not beyond the tail end of the soldering zone 12. Each upper ground terminal 22 and the corresponding lower ground terminal 32 are positioned in the same vertical direction. In other embodiments, each upper ground terminal 22 and the corresponding lower ground terminal 32 also do not need to be in the same vertical direction. The upper signal terminal 23 has an upper soldering pin 231, the upper soldering pin 231 and the upper soldering portion 212 are in the same row, and the center of the upper soldering portion 212 is lower than that of the upper soldering pin 231. The lower row terminal group 3 has multiple lower signal terminals 33, the lower signal terminal 33 has a lower soldering pin 331, the lower soldering pin 331 and the lower soldering portion 312 are in the same row, and the center of the lower soldering portion 312 is higher than that of the lower soldering pin 331. The upper signal terminal 23 is exposed to the upper terminal slot 121 and is lower than the top end of the terminal slot but not beyond the tail end of the upper terminal slot 121. The lower signal terminal 33 is exposed to the lower terminal slot 122 and is higher than the bottom end of the lower terminal slot 122 but not beyond the tail end of the lower terminal slot 122. The upper row terminal group 2 and the lower row terminal group 3 both have 12 terminals, the terminals are arranged in the same order. The upper row terminal group 2 and the lower row terminal group 3 are arranged in a point symmetry way by taking the central point of the insulating body 1 as a center of symmetry, and both the upper row terminal group 2 and the lower row terminal group 3 meet the USB TYPE C terminal arrangement. In the present embodiment, the electrical connector 100 is a USB TYPE C connector. In other embodiments, the electrical connector 100 can also be electrical connectors with other specifications, and one or more upper ground terminals 22, upper power terminals 21, lower ground terminals 32 and lower power terminals 31 are arranged, as long as they correspond to the cable 200.

Figure 5:
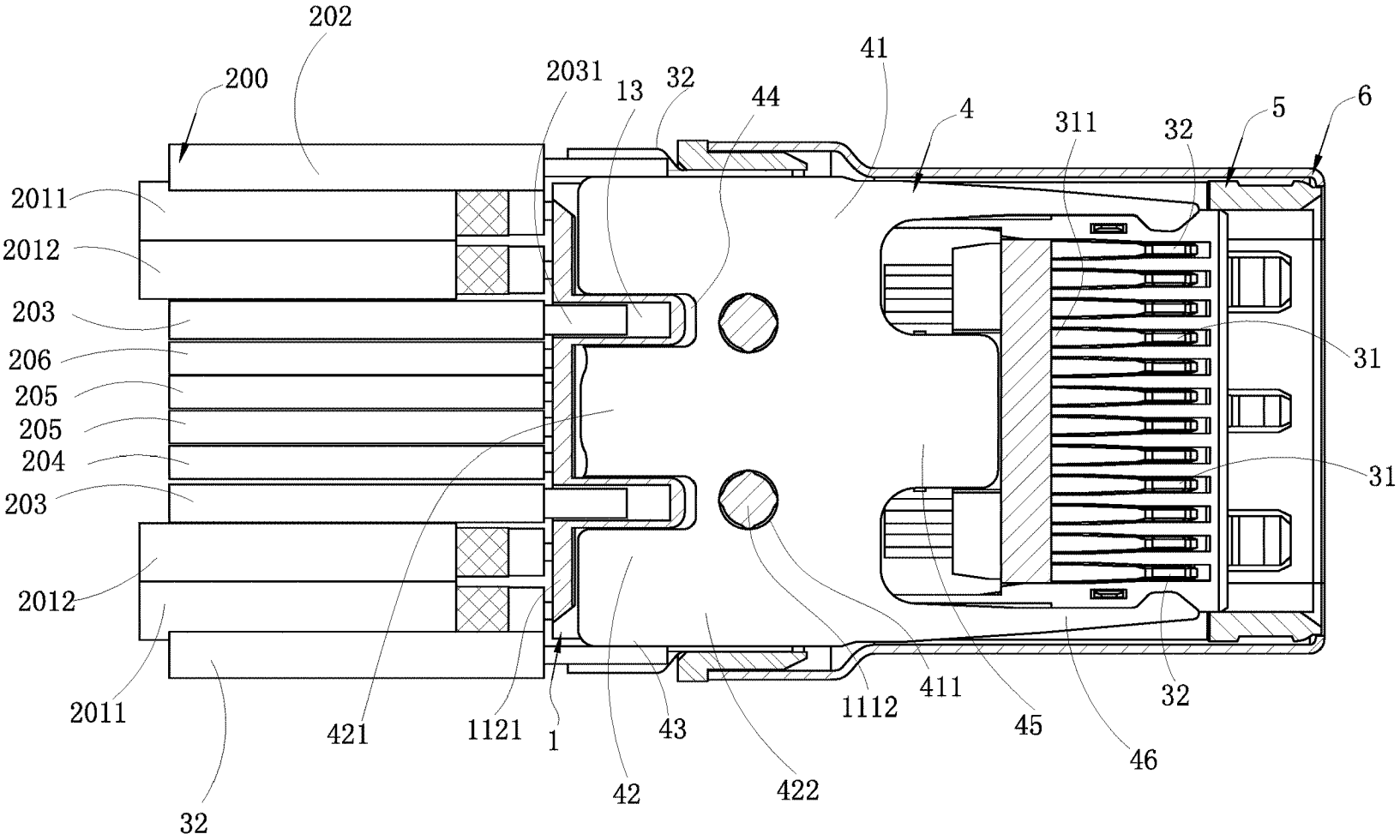
FIG. 5 is a plan view of FIG. 4.

As shown in FIGS. 1, 5 and 6, the middle shielding sheet 4 has a base 41, the base 41 is provided with two perforations 411 corresponding to the fixing posts 1112, the fixing posts 1112 are engaged with the perforations 411. The main body 11 wraps the base 41, the base 41 extends backward to form an extending portion 42, and the upper protruding rib 1113 and the lower protruding rib 1121 cover the rear end of the extending portion 42. The extending portion 42 is recessed with two yield slots 44 corresponding to the power terminals, and the width of the yield slots 44 is greater than that of the upper soldering portion 212 and the lower soldering portion 312. The insulating body 1 is provided with a through slot 13 corresponding to the yield slot 44, the width of the through slot 13 is smaller than that of the yield slot 44, and the through slot 13 covers the yield slot 44. The extending portion 42 has a middle plate 421 and two side plates 422, the side plate 422 is positioned at both sides of the middle plate 421. The middle plate 421 is buried in the insulating body 1, the side plate 422 is partially buried in the insulating body 1 and partially exposed to the insulating body 1 to form a soldering end 43, the yield slot 44 is positioned between the side plate 422 and the middle plate 421, the tail end of the middle plate 421 is not flush with the tail end of the side plate 422, and the horizontal widths of the middle plate 421 and the side plate 422 are equal. The upper signal terminal 23 is positioned over the extending portion 42, and the lower signal terminal 33 is positioned under the extending portion 42. The base 41 is provided with a perforation 411, and the perforation 411, the wire core 2031 and the yield slot 44 are positioned on the same straight line. The middle of the base 41 extends forward to form a protruding portion 45, the protruding portion 45 is engaged with the lower insulating block 112, two sides of the base 41 extend forward to form a pair of extending arms 46, and the extending arms 46 are engaged with the insulating shell 5.

As shown in FIGS. 1, 4 and 6, the cable 200 has eight coaxial wires 201, two ground wires 202 and two power supply wires 203. The diameter of the coaxial wire 201 is greater than that of other wires of the cable 200. The ground wire 202 is soldered with the soldering end 43, and the ground wire 202 extends to a part between the upper ground terminal 22 and the lower ground terminal 32, and is soldered with the upper ground terminal 22 and the lower ground terminal 32 by tin solder. The coaxial wires 201 and the power wires 203 are arranged up and down in a staggered manner. The power wire 203 has a wire core 2031, and the wire core 2031 enters the yield slot 44, extends to a part between the upper soldering portion 212 and the lower soldering portion 312, and is soldered with the upper soldering portion 212 and the lower soldering portion 312. A gap exists between the through slot 13 and the wire core 2031. The cable 200 is sequentially provided with a ground wire 202, a first high-speed signal wire 2011, a second high-speed signal wire 2012, a power wire 203, a detection wire 204, a pair of USB 2.0 wires 205, a reserved wire 206, a power wire 203, a second high-speed signal wire 2012, a first high-speed signal wire 2011, and a ground wire 202 corresponding to the upper row terminal group 2. Except for the ground wire 202 and the power wire 203, other wires of the cable 200 are respectively arranged up and down in pairs, and the first high-speed signal wire 2011 and the second high-speed signal wire 2012 are the coaxial wires 201.

Compared with the related art, the electrical connector assembly according to certain embodiments of the present invention, among other things, has the following beneficial advantages.

1. The extending portion 42 is provided with the yield slots 44 corresponding to the upper power terminal 21 and the lower power terminal 31, the upper signal terminal 23 is positioned over the extending portion 42, the lower signal terminal 33 is positioned under the extending portion 42, and only one power wire 203 is soldered with the upper soldering portion 212 and the lower soldering portion 312, thus reducing the use of the power wire 203, saving the space of the soldering zone 12 without affecting the shielding effect of the middle shielding sheet 4 on the upper row terminal group 2 and the lower row terminal group 3 compared with the situation that each power wire 203 is separately soldered with one upper power terminal 21 or lower power terminal 31.

2. The width of the yield slot 44 is greater than that of the upper soldering portion 212 and the lower soldering portion 312, thus ensuring that an enough distance exists between the upper soldering portion 212 and the lower soldering portion 312 and the middle shielding sheet 4 to prevent short circuit.

3. Only one ground wire 202 extends to a part between the upper ground terminal 22 and the lower ground terminal 32 and is soldered with the upper ground terminal 22 and the lower ground terminal 32, the ground wire 202 is electrically connected with the middle shielding sheet 4, thus saving space, reducing the use of the cable 200 and also ensuring the ground effect of the electrical connector 100 compared with the situation that one upper ground terminal 22 and one lower ground terminal 32 are respectively soldered with the ground wire 202.

4. A gap exists between the through slot 13 and the wire core 2031 so as to ensure that the wire core 2031 can be soldered with the upper soldering portion 212 and the lower soldering portion 312 by adding enough tin solder after the wire core 2031 extends to the through slot 13.

5. The upper soldering portion 212 and the lower soldering portion 312 extend backward but not beyond the insulating body 1 to prevent the tin solder from overflowing the terminal slot to contact the cable 200 around when the cable 200 is soldered with the upper soldering portion 212 and the lower soldering portion 312.

6. The center of the upper soldering portion 212 is lower than that of the upper soldering pin 231 in the vertical direction, and the center of the lower soldering portion 312 is higher than that of the lower soldering pin 331 in the vertical direction, thus ensuring that an enough distance exists between the upper soldering pin 231 and the middle shielding sheet 4 when the upper soldering portion 212 and the upper soldering pin 231 are arranged in the same row to improve high frequency, and ensuring that an enough distance exists between the lower soldering pin 331 and the middle shielding sheet 4 when the lower soldering portion 312 and the lower soldering pin 331 are arranged in the same row to improve high frequency.

7. An upper protruding rib 1113 is arranged at the rear end of the lower surface of the upper insulating block 111, a lower protruding rib 1121 is arranged at the rear end of the upper surface of the lower insulating block 112, and the upper protruding rib 1113 and the lower protruding rib 1121 cover the rear end of the extending portion 42, thus preventing the tin solder and the middle shielding sheet 4 from contacting to generate short circuit when the power wire 203 is soldered with the upper power terminal 21 and the lower power terminal 31.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

an insulating body;

a middle shielding sheet, arranged in the insulating body, and having a base and an extending portion extending backward from the base, at least one yield slot recessed from the extending portion;

an upper row terminal group and a lower row terminal group, fixedly to the insulating body and respectively positioned at an upper side and a lower side of the middle shielding sheet, wherein the upper row terminal group includes at least one upper power terminal and a plurality of upper signal terminals, the upper power terminal extends to form an upper soldering portion entering a part above the yield slot, the upper signal terminals are positioned over the extending portion, the lower row terminal group includes at least one lower power terminal and a plurality of lower signal terminals, the lower power terminal extends to form a lower soldering portion entering a part below the yield slot, and the lower signal terminals are positioned under the extending portion; and a cable having at least one power wire, wherein the power wire has a wire core, the wire core enters the yield slot, extends to a location between the upper soldering portion and the lower soldering portion, and is soldered with the upper soldering portion and the lower soldering portion.

2. The electrical connector assembly of claim 1, wherein a width of the yield slot is greater than a width of the upper soldering portion and the lower soldering portion.

3. The electrical connector assembly of claim 1, wherein the cable comprises a plurality of signal wires, and the power wire and the signal wires are arranged up and down in a staggered manner along the horizontal direction.

4. The electrical connector assembly of claim 1, wherein the upper row terminal group includes at least one upper ground terminal, the lower row terminal group includes at least one lower ground terminal, the upper ground terminal and the lower ground terminal are positioned in a same vertical direction, the cable comprises a ground wire, the ground wire extends to a location between the upper ground terminal and the lower ground terminal, and is electrically connected with the upper ground terminal and the lower ground terminal.

5. The electrical connector assembly of claim 4, wherein the ground wire is electrically connected with the middle shielding sheet.

6. The electrical connector assembly of claim 4, wherein a center of the power wire and a center of the ground wire are positioned on a same horizontal plane.

7. The electrical connector assembly of claim 1, wherein the insulating body is provided with a through slot corresponding to the yield slot, and a gap exists between the through slot and the wire core.

8. The electrical connector assembly of claim 7, wherein a width of the through slot is smaller than a width of the yield slot, and the through slot covers the yield slot.

9. The electrical connector assembly of claim 1, wherein the upper row terminal group includes a plurality of upper signal terminals, each of the upper signal terminals has an upper soldering pin, a center of the upper soldering portion is lower than a center of the upper soldering pin in a vertical direction, the lower row terminal group includes a plurality of lower signal terminals, the lower signal terminal has a lower soldering pin, and a center of the lower soldering portion is higher than a center of the lower soldering pin in the vertical direction.

10. The electrical connector assembly of claim 1, wherein the upper soldering portion and the lower soldering portion extend backward but not beyond the insulating body.

11. The electrical connector assembly of claim 1, wherein both the upper row terminal group and the lower row terminal group includes 12 terminals, the upper row terminal group and the lower row terminal group are arranged in a point symmetry way by taking a central point of the insulating body as a center of symmetry, and both the upper row terminal group and the lower row terminal group meet universal serial bus (USB) TYPE C terminal arrangement.

12. The electrical connector assembly of claim 1, wherein the insulating body has a main body, the main body is formed by combining an upper insulating block with a lower insulating block, an upper protruding rib is arranged at a rear end of a lower surface of the upper insulating block, a lower protruding rib is arranged at a rear end of an upper surface of the lower insulating block, and the upper protruding rib and the lower protruding rib cover a rear end of the extending portion.

13. The electrical connector assembly of claim 12, wherein at least one of the upper insulating block and the lower insulating block is provided with a fixing post corresponding to the perforation.

14. The electrical connector assembly of claim 1, wherein the base is provided with a perforation, and the perforation, the wire core and the yield slot are positioned on a same straight line.

15. The electrical connector assembly of claim 14, wherein at least one of the upper insulating block and the lower insulating block is provided with a fixing post corresponding to the perforation.

16. The electrical connector assembly of claim 1, wherein the extending portion has a middle plate and at least one side plate, the side plate is respectively positioned on one side of the middle plate, the middle plate is buried in the insulating body, and the side plate is partially buried in the insulating body, and is partially exposed to the insulating body to form a soldering end.

17. The electrical connector assembly of claim 16, wherein a tail end of the middle plate is not flush with tail ends of the two side plates.

18. The electrical connector assembly of claim 16, wherein horizontal widths of the middle plate and the side plate are equal.

19. The electrical connector assembly of claim 1, wherein a middle of the base extends forward to form a protruding portion, and two sides of the base extend forward to form a pair of extending arms.

* * * * *